US008099910B1

(12) United States Patent
Gaines

(10) Patent No.: US 8,099,910 B1
(45) Date of Patent: Jan. 24, 2012

(54) ROOF HATCH GRAB BARS

(76) Inventor: Robert G Gaines, Brighton, MI (US)

( * ) Notice: Subject to any disclaimer, the term of this patent is extended or adjusted under 35 U.S.C. 154(b) by 614 days.

(21) Appl. No.: 12/115,293

(22) Filed: May 5, 2008

Related U.S. Application Data

(60) Provisional application No. 60/915,804, filed on May 3, 2007.

(51) Int. Cl.
*A47L 3/00* (2006.01)

(52) U.S. Cl. ..... 52/37; 52/33; 52/40

(58) Field of Classification Search ..... 52/37, 27, 52/33, 40, 20; 182/106
See application file for complete search history.

(56) References Cited

U.S. PATENT DOCUMENTS

| | | | | |
|---|---|---|---|---|
| 5,931,258 | A * | 8/1999 | Lorentz | 182/93 |
| 6,167,659 | B1 | 1/2001 | Swindell | |
| 6,272,800 | B1 | 8/2001 | Phinney et al. | |
| 6,607,053 | B1 * | 8/2003 | Warren | 182/106 |
| 6,681,528 | B1 | 1/2004 | Profeta et al. | |
| 7,516,575 | B2 * | 4/2009 | Cuccurullo | 52/20 |

* cited by examiner

*Primary Examiner* — Basil Katcheves
(74) *Attorney, Agent, or Firm* — Cargill & Associates, PLLC; Lynn E. Cargill

(57) ABSTRACT

A roof hatch grab bar assembly for adding comfort to a person ascending or descending a roof hatch and its complementary through the roof ladder. The roof hatch grab bar assembly includes grab bar handrails and a cross support assembly with side supports on either side that include telescoping arms. The design is adjustable, easily installed and will not crush the insulation surrounding a roof hatch that is conventionally adhered to the hatch. Installation may be done while minimizing the potential for leaks in the roof.

3 Claims, 5 Drawing Sheets

ROOF HATCH GRAB BARS

PRIORITY DATA

This non-provisional patent application claims priority of May 3, 2007 based on the filing of a U.S. Provisional Application having a Ser. No. 60/915,805 filed May 3, 2007.

TECHNICAL FIELD

This invention relates to a safety device for use with rooftop applications, and more particularly relates to a new device for attaching grab bars to the top of a roof hatch.

BACKGROUND OF THE INVENTION

In many industrial and/or commercial buildings a roof hatch is attached as a through hole to the top of the roof for maintenance performance. As one may know from using a roof hatch, it is quite dangerous to climb up onto the roof through the hatch without having a secure grab hold to steady a maintenance person carrying a lot of tools and/or equipment.

It would be an advantage to secure a roof hatch grab bar to a roof hatch in order to allow stability and security for maintenance personnel and/or anyone climbing up onto the top of an industrial roof. It would also be an advantage to provide stability to a maintenance person for bringing equipment and tools up onto the roof to perform the maintenance procedures.

A need has arisen for a grab bar assembly that is easy to install for adjustable roof hatch dimensions, without crushing the insulation around the hatch. As other hatch safety railing systems typically crush the insulation, thereby causing leaks into the building below, it would be a real advantage to provide a new, non-crushing design.

U.S. Pat. No. 6,167,659 issued Jan. 2, 2001 to Harold Swindell III is a prior art hatch rail system, but is not a non-crushing design, leaking to potential leaks.

U.S. Pat. No. 6,681,528 issued Jan. 24, 2004 to Profeta, et. al, also disclosed a prior art hatch rail system, although it also poses a problem with the insulation as well as causing potential leak problems.

SUMMARY OF THE INVENTION

In accordance with the above-mentioned advantages, one aspect of the present invention is to provide a telescoping roof hatch safety grab bar making ascent and descent through a roof hatch more comfortable and secure. Specific adjustable features allow the roof hatch grab bar assembly to fit all standard roof hatches, while meeting OSHA regulation 1910.27(d)(3).

In another aspect of the present invention, a caged roof hatch safety grab bar system provides an added measure of comfort to an existing roof hatch. Again, the construction is fully adjustable to fit all standard roof hatch sizes, and enabling easy installation without crushing any insulation around the roof hatch.

In yet another aspect of the present invention, a back bar caged safety grab bar set is further disclosed for non-standard hatch orientation where lid hinges at the side instead of the back of the roof hatch.

BRIEF DESCRIPTION OF THE DRAWINGS

For a further understanding of the nature and advantages of the expected scope and various embodiments of the present invention, reference shall be made to the following detailed description, and when taken in conjunction with the accompanying drawings, in which like parts are given the same reference numerals, and wherein.

DETAILED DESCRIPTION OF THE DRAWINGS

Figure 1:
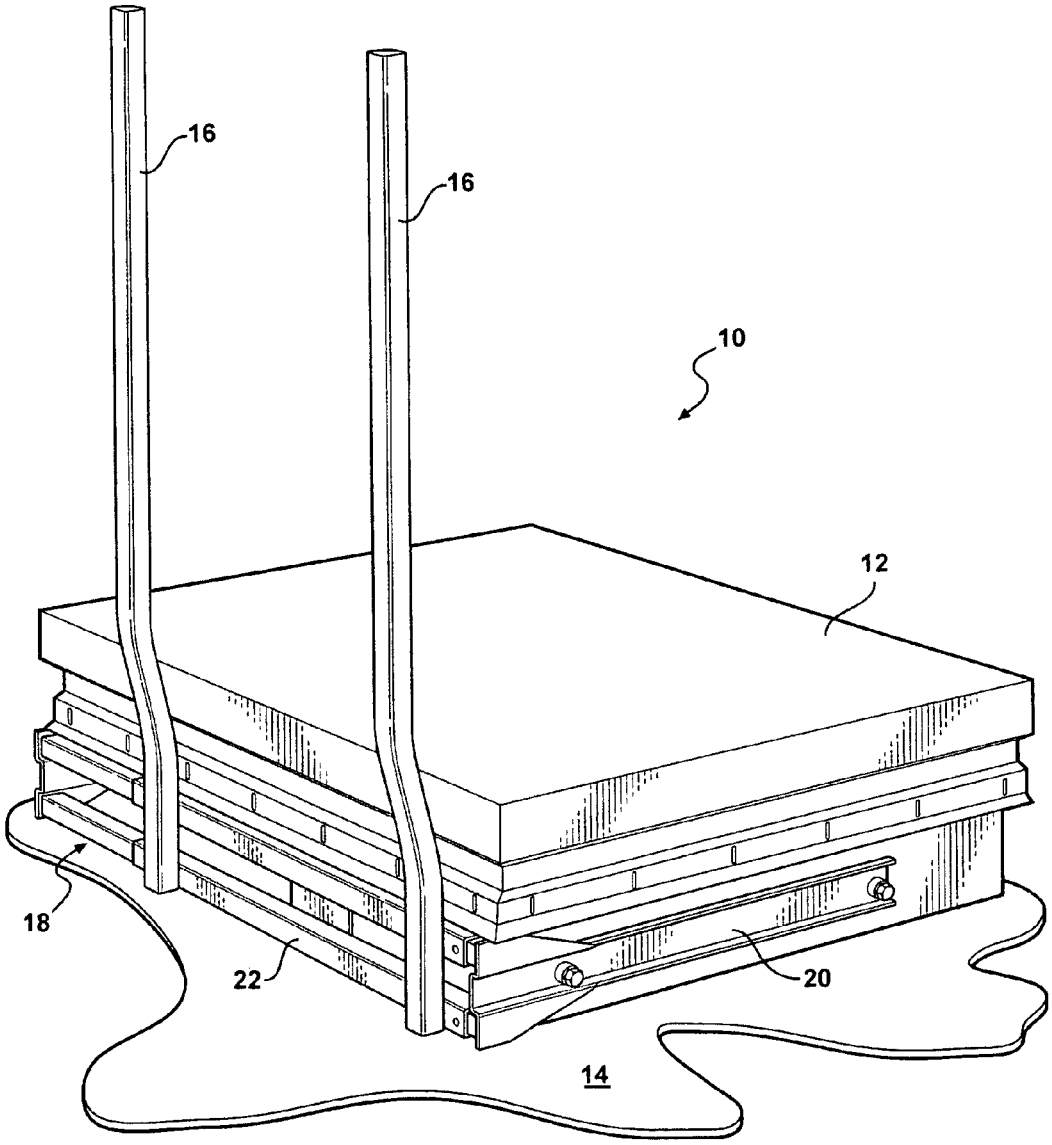
FIG. 1 is an environmental perspective view of a roof hatch grab bar assembly made in accordance with the present invention.

Looking first to FIG. 1, a new roof hatch grab bar assembly made in accordance with the present invention is shown in-situ perspective view to show relative placement of the assembly once it is installed. A roof hatch grab bar is generally denoted by the numeral 10 and is shown installed on a roof hatch 12 coming through a roof 14. Roof hatch grab bar assembly 10 includes grab bar hand rails 16 and a cross support assembly denoted by the numeral 18, including side supports 20 on either side. Side supports 20 include telescoping arms which are received by hollow cylindrical cross supports 22.

As one can see, when roof hatch 12 is in the open position, a maintenance worker can climb up the ladder, through roof 14, and grab a hold of handrails 16 to steady himself as he is entering onto roof 14. Preferably an anti-slip mat may be placed in front of handrail 16 to have a non-slip surface for the maintenance to egress and ingress through the roof hatch 12.

Figure 2:
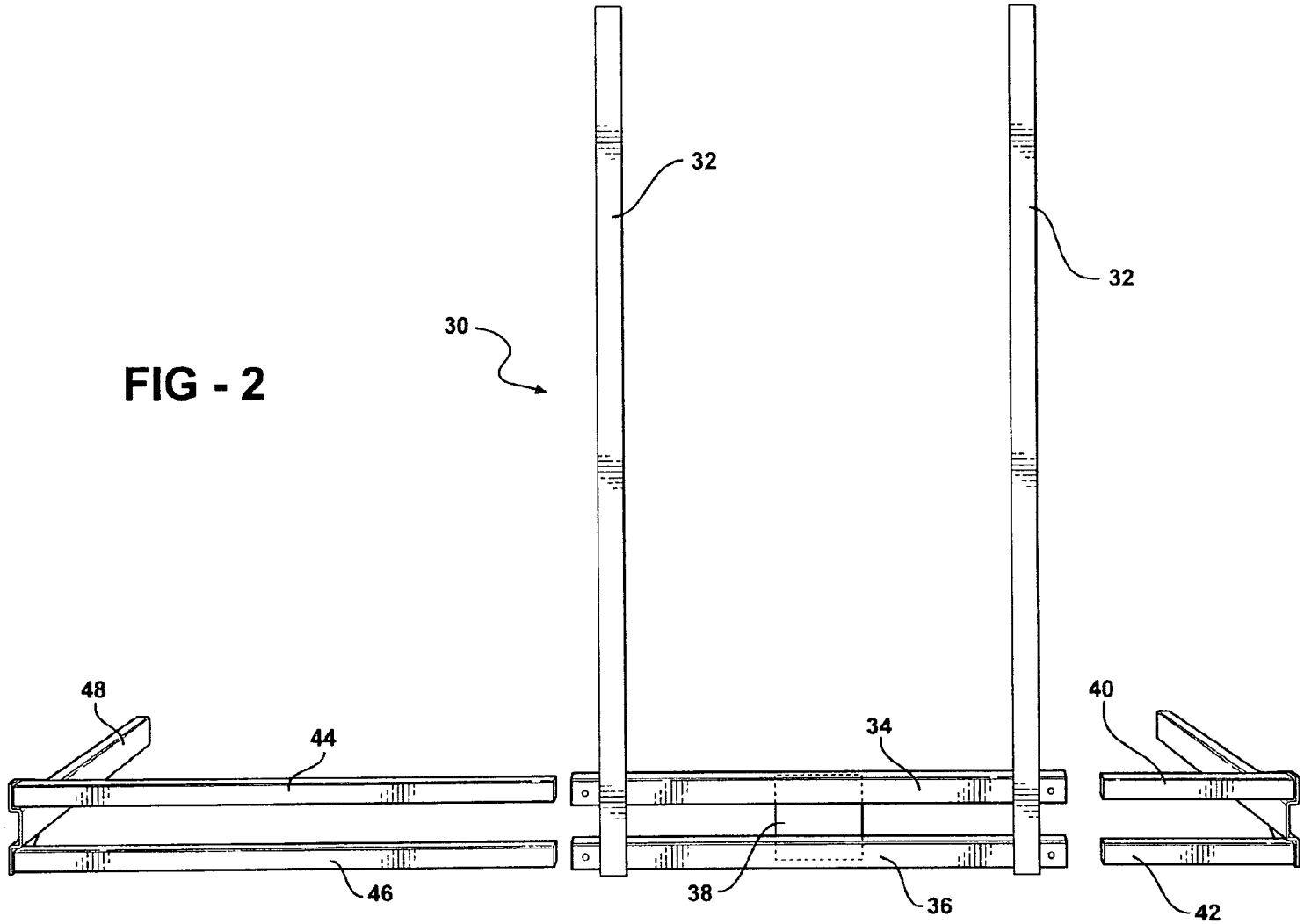
FIG. 2 is a front elevational exploded view of the grab bar assembly.

Looking next to FIG. 2, an exploded view of the roof hatch grab bar assembly 10 is shown, and is generally denoted by numeral 30 including handrails 32 and gives more detail about the cross support denoted by numeral 22 of FIG. 1. Handrails 32 are welded to a top and bottom cross support hollow cylindrical receiving tube, 34 and 36 respectively, which are also welded to back plate 38. Looking to the right side of FIG. 2, there is shown a side support with a top inner cross support 40 and a lower inner cross support 42 both welded to a side support.

Looking to the left of FIG. 2, there is shown a left inner cross support on the upper member 44 and a lower member 46 both welded to a side support 48. As will be shown in greater detail hereinbelow, the upper and lower right inner cross supports 40 and 42 are received within the upper and lower facing cross supports, 34 and 36 respectively. Likewise, the left inner cross support upper member 44 and lower member 46 are also received within the face cross support upper and lower members, 34 and 36 respectively. After the arms are received by the face cross support, holes are tapped through the cylindrical tube to secure the inner cross supports therein for stability and security. The installation becomes final when the sides are attached to the sides of the roof curb.

Figure 3:
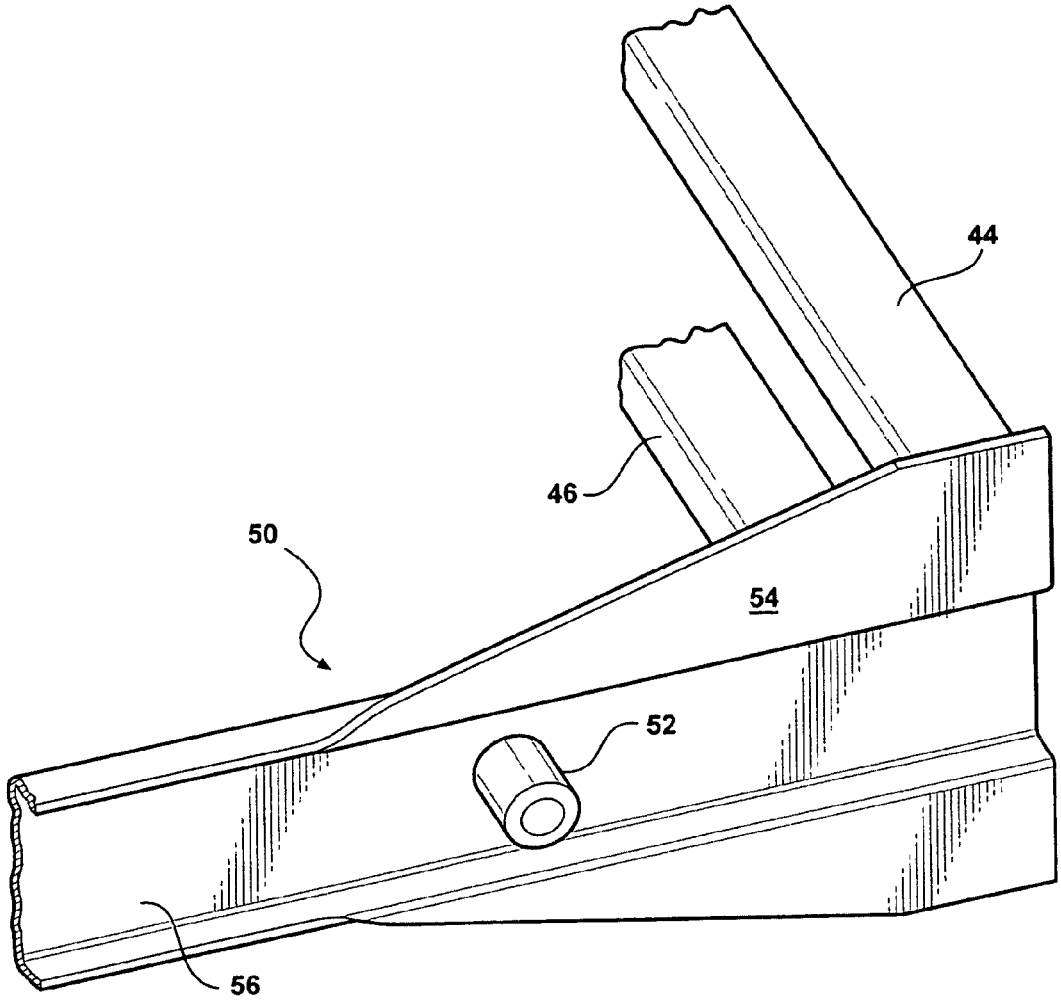
FIG. 3 is a close up of a stand-off tube in relation to the grab bar assembly.

FIG. 3 shows in detail the side support generally denoted by numeral 50, including a side rail 56 with a stand-off bolt receiving member 52 integral with inner cross supports upper member 44 and lower member 46. Upper and lower members 44 and 46 are welded to the interior facing side of the face 54.

Stand-off 52 is helpful for receiving a nut and bolt that is attached to the side of the roof curb shown in FIG. 1 where the side support is bolted through the bottom of roof hatch 12, i.e. the roof curb. The stand-off is useful because the material on the side of the roof curb is spongy and insulative, and, if a bolt goes through a single area, it may twist and turn with use and become loose from its point of entry into the roof hatch 12. By providing the extended length as shown in stand-off 52 of FIGS. 3 and 4, the bolt is held into position, and is not allowed to wiggle to become dislodged. This feature should also alleviate leaks caused by installation issues.

Figure 4:
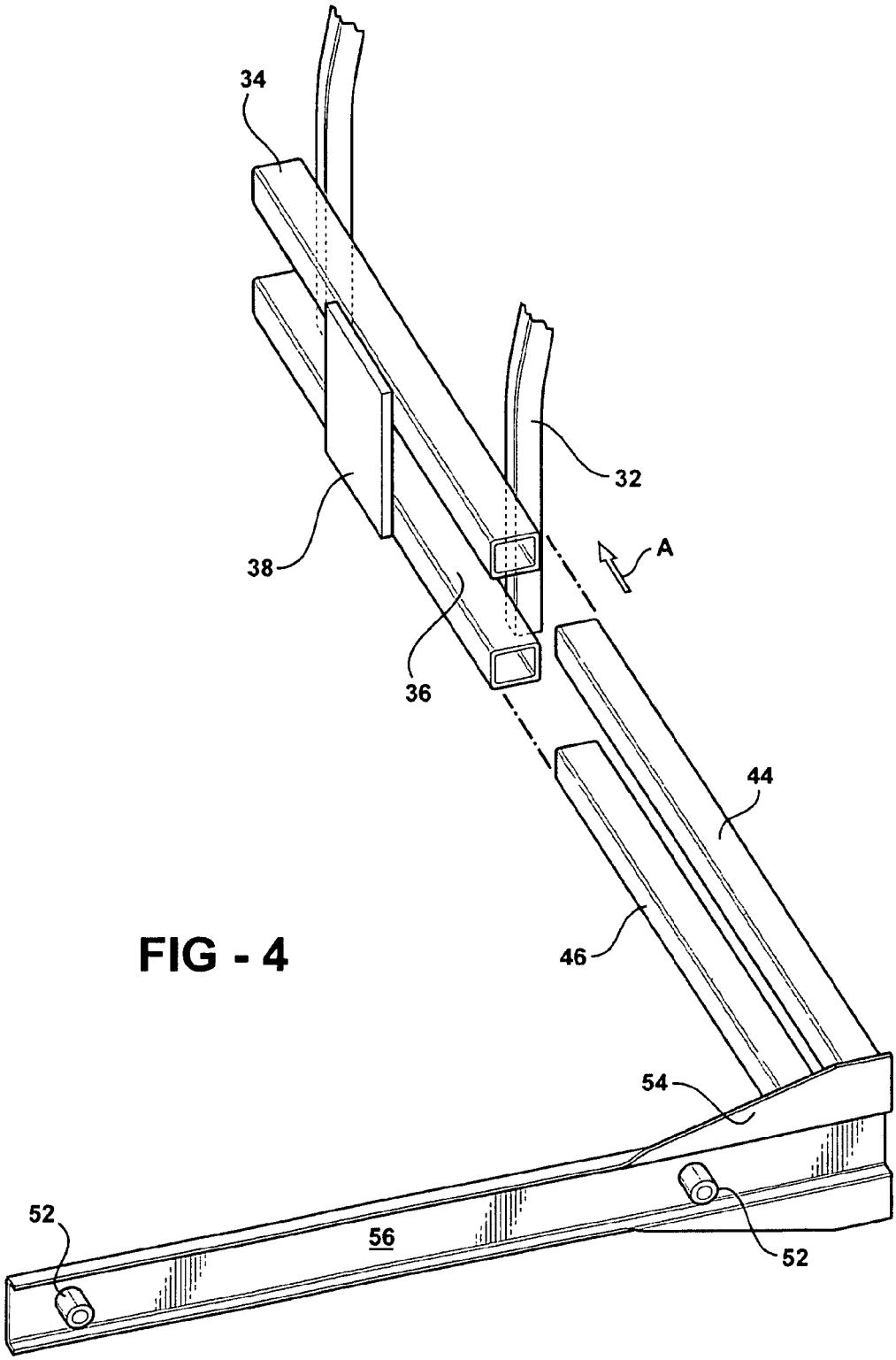
FIG. 4 is a side elevational perspective view of the grab bar assembly of FIG. 1.

Looking at FIG. 4, a perspective view of the roof hatch grab bar is shown so that the telescoping effect of upper and lower inner cross members 44 and 46 can travel in direction "A" into upper and lower cross support members 34 and 36 respectively. As upper and lower face cross support members 34 and 36 are welded to back plate 38 on the back and to handrails 32 on the front, the cross supports are held in good securement to the upper and lower inner cross support members 44 and 46, which are in turn welded to the side support receiving member 54, which is integral with side rail 56. During assembly, bolts are put through stand-offs 52 and attached to the side of the roof curb, as is more clearly shown in FIG. 5.

Figure 5:
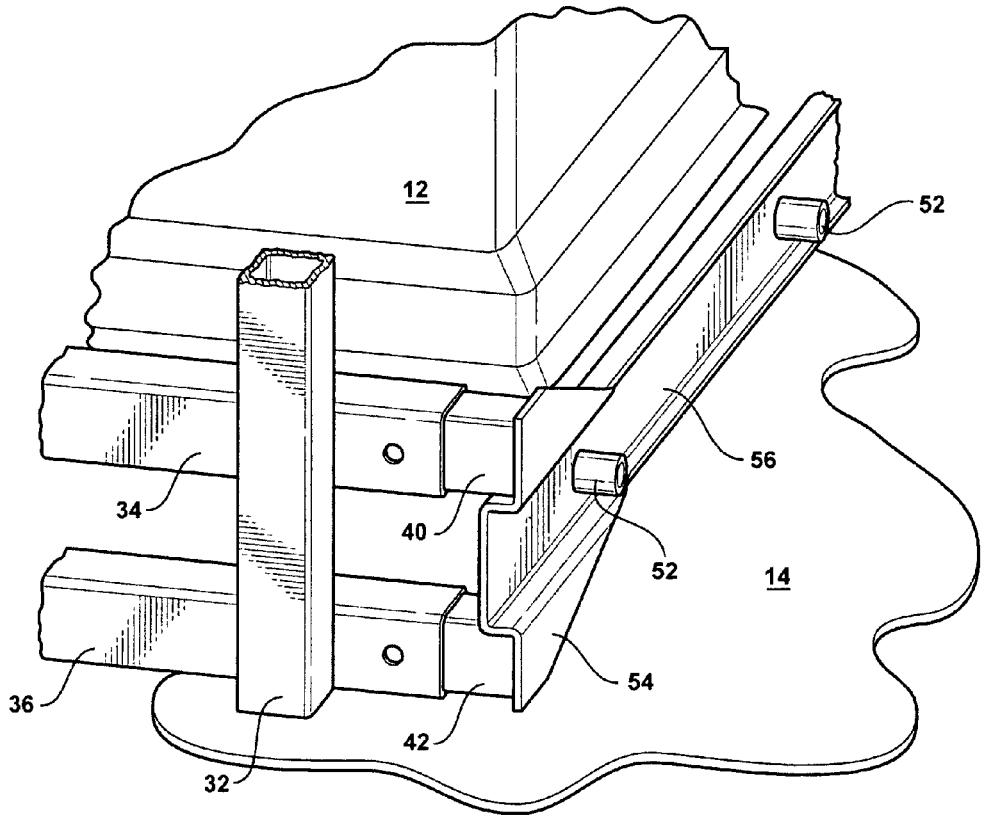
FIG. 5 is a front perspective view of the telescoping feature of the invention of FIG. 1.

FIG. 5 shows a close-up of the roof hatch 12 receiving the roof hatch grab bar of the present invention. The right side inner cross member upper and lower parts 40 and 42 are shown telescopically received by the upper and lower 34 and 36 cross members of the face cross support and secured thereto and therethrough. The side rail 56 is shown with the stand-offs 52 abutting on the backside, the roof curb underneath roof hatch 12. Note that handrails 32 preferably rest upon roof 14, without placing too much pressure on the roof as it is spongy and will not support a great deal of weight in one small place. Preserving the integrity of these spongy materials keeps installation issues to a minimum.

Although the invention has been described by way of examples hereinabove for specific embodiments having certain features, it must also be realized that minor modifications that do not require undo experimentation on the part of the practitioner are covered within the scope and breadth of this invention. Additional advantages and other novel features of the present invention will be apparent to those skilled in the art upon examination or may be learned within the practice of the invention. Therefore, the invention is capable of many other different embodiments and its details are capable of modifications of various aspects which will be obvious to those of ordinary skill in the art all without departing from the spirit of the present invention.

What is claimed is:

1. A roof hatch grab bar assembly to be secured around the outside of a roof hatch housing a ladder for accessing the roof, comprising:

upwardly extending permanently attached grab bar hand rails which are also permanently centered on the ladder;

a hollow cross support assembly having apertures at either end supporting and permanently welded to the grab bar hand rails;

at least two side supports including telescoping arms adapted to be received within the apertures of the hollow cross support assembly around the base of the outside of the roof hatch housing, said at least two side supports further including a side rail welded to the side supports; and each side rail having an integral stand-off bolt receiving member, whereby bolt movement is minimized to prevent damage to roof hatch insulation from damage; and whereby the upwardly extending grab bar hand rails are permanently attached to the hollow cross support assembly to add comfort to a person ascending or descending the ladder.

2. The roof hatch grab bar assembly of claim 1, further comprising telescoping arm attachment to vertical surfaces of the roof hatch housing for minimizing roof and insulation damage due to installation.

3. The roof hatch grab bar assembly of claim 1, further comprising adjustability for use on many roof hatch openings by scoping the telescoping arms of the at least two side supports to allow for permanent attachment around a roof hatch, and attachment to vertical surfaces of the roof hatch housing.

* * * * *